United States Patent [19]

Kunimoto

[11] Patent Number: 4,818,545

[45] Date of Patent: Apr. 4, 1989

[54] FOOD MATERIAL-CONTAINER COMBINATION

[75] Inventor: Yuji Kunimoto, Koube, Japan

[73] Assignee: House Food Industrial Company Limited, Higashiosaka, Japan

[21] Appl. No.: 815,464

[22] Filed: Jan. 2, 1986

[30] Foreign Application Priority Data

Jan. 11, 1985 [JP] Japan ..... 60-2945

[51] Int. Cl.[4] ..... B65D 81/34

[52] U.S. Cl. ..... 426/107; 426/113; 426/115; 426/122; 426/127; 219/10.55 E; 206/627; 383/104; 383/119; 229/903

[58] Field of Search ..... 426/113, 114, 112, 107, 426/111, 118, 234, 241, 243, 412, 115, 122, 123, 414; 383/104, 119; 229/903, 905, 902, 906; 206/627

[56] References Cited

U.S. PATENT DOCUMENTS

| | | | |
|---|---|---|---|
| 2,347,161 | 4/1944 | Watts et al. | 426/122 |
| 2,444,895 | 7/1948 | Ringler | 229/905 |
| 2,596,620 | 5/1952 | Townsend | 206/627 |
| 2,600,566 | 6/1952 | Moffett | 426/234 |
| 2,660,530 | 11/1953 | Adams | 426/412 |
| 2,689,183 | 9/1954 | Colt | 426/113 |
| 2,698,248 | 12/1954 | Peters | 426/112 |
| 2,706,076 | 4/1955 | Guyer | 206/627 |
| 2,714,070 | 7/1955 | Welch | 426/234 |
| 2,828,858 | 4/1958 | Tooke | 383/38 |
| 2,858,970 | 11/1958 | Barnes et al. | 426/111 |
| 2,865,552 | 12/1958 | Sider et al. | 206/627 |
| 2,865,768 | 12/1958 | Barnes et al. | 426/111 |
| 2,917,221 | 12/1959 | Risdon | 229/125 |
| 3,144,931 | 8/1964 | Long | 426/112 |
| 3,219,460 | 11/1965 | Brown | 426/107 |
| 3,228,776 | 1/1966 | Savage et al. | 426/114 |
| 3,240,610 | 3/1966 | Cease | 426/113 |
| 3,271,169 | 9/1966 | Baker et al. | 426/107 |
| 3,380,834 | 4/1968 | Janoutchik et al. | 426/112 |
| 3,465,873 | 9/1969 | Munz | 426/114 |
| 3,542,190 | 11/1970 | Keller | 426/115 |
| 3,681,094 | 8/1972 | Rogers et al. | 426/113 |
| 3,689,291 | 9/1972 | Draper | 426/113 |
| 3,865,301 | 2/1975 | Pothier et al. | 426/107 |
| 3,873,738 | 3/1975 | Zoeller et al. | 426/111 |
| 4,036,423 | 7/1977 | Gordon | 229/903 |
| 4,081,646 | 3/1978 | Goltsos | 426/107 |
| 4,094,996 | 6/1978 | Sakakibara et al. | 426/115 |
| 4,133,996 | 1/1979 | Fread | 426/243 |
| 4,219,573 | 8/1980 | Borek | 426/107 |
| 4,292,332 | 9/1981 | McHam | 426/118 |
| 4,348,421 | 9/1982 | Sakakibara et al. | 426/509 |
| 4,358,466 | 11/1982 | Stevenson | 426/118 |
| 4,444,795 | 4/1984 | Weinstein | 426/122 |
| 4,525,367 | 6/1985 | Allison | 426/113 |
| 4,553,010 | 11/1985 | Bohrer et al. | 426/243 |
| 4,558,785 | 12/1985 | Gordon | 206/627 |
| 4,571,337 | 2/1986 | Cage et al. | 426/118 |
| 4,586,649 | 5/1986 | Webinger | 426/123 |
| 4,590,078 | 5/1986 | Umina | 426/113 |
| 4,592,914 | 6/1986 | Kuchenbecker | 426/107 |

FOREIGN PATENT DOCUMENTS

| | | | |
|---|---|---|---|
| 704569 | 3/1965 | Canada | 426/112 |
| 969139 | 6/1975 | Canada | 426/114 |
| 0038114 | 10/1981 | European Pat. Off. . | |
| 1815941 | 7/1970 | Fed. Rep. of Germany . | |
| 2643225 | 3/1978 | Fed. Rep. of Germany | 426/113 |
| 1125895 | 6/1955 | France . | |
| 4516773 | 6/1970 | Japan | 426/412 |
| 965498 | 7/1964 | United Kingdom | 426/113 |
| 2113960 | 8/1983 | United Kingdom . | |

*Primary Examiner*—Steven Weinstein

*Attorney, Agent, or Firm*—Oblon, Fisher, Spivak, McClelland & Maier

[57] ABSTRACT

This invention provides a food material-container combination which allows the food material to be cooked and solidified by simple operations without a pot, and which simplifies the work of cleaning up after cooking. Referring to FIG. 1, a self-standing container 11 has an opening 12 at the top portion thereof. A food material such as tofu material is charged in the container 11 together with water. The upper portion 13 is sealed by folding it by hand. The container and contents are then thoroughly shaken, whereafter the content of the container 11 is heated by a microwave oven. After a prescribed period of heating, the container 11 is taken out from the microwave oven and the container is cut along the line 16. The end product can then be removed.

2 Claims, 3 Drawing Sheets

(I)

(II)

(III)

(IV)

FOOD MATERIAL-CONTAINER COMBINATION

BACKGROUND OF THE INVENTION (1) Field of the Invention

The present invention relates to a food material-container combination comprising (1) a food material, such as tofu, which solidifies after being added with water and cooked and (2) a container suitable for holding said food material during solidification and cooking. Such a food material-container combination is advantageous in, for example, that the food material can be cooked by simple operation without using a pot or the like.

(2) Description of the Prior Art

Recently, tofu material for making tofu and other such materials have been marketed as packed in containers so that customers are able to cook the material at home and enjoy the taste of home-made tofu or the like. However, said cooking involves some disadvantages. For example, it is necessary to use some kind of pot; these foods cannot be cooked easily and in a short time; and the work of cleaning up after making the tofu etc. is troublesome. This is because, for example, tofu is conventionally cooked as follows: In the first stage, the main ingredients, such as soybean protein and an appropriate amount of water, are charged in a pot and boiled under stirring with a whisk. After sufficient boiling, the boiling is stopped, and a coagulant is immediately added thereto. Then the boiled mixture is stirred several times and charged into a plastic container. The plastic container is left to stand for about 20 minutes to allow the content thereof to solidify, after which the tofu is put in water to remove its harshness. Accordingly, it is necessary for making tofu to use a pot, a whisk and a plastic container. It is also necessary to stir it with a whisk during boiling. Moreover, the cooking operation consists of 2 stages.

SUMMARY OF THE INVENTION

Under such circumstances, the present inventors made various studies and developed a combination of a specially constituted self-standing container made from water resisting material and a food material which solidifies after cooking, by which combination a solid food can be easily prepared by cooking without use of a pot, i.e., by using only the self-standing container.

It is therefore a primary object of the present invention to provide a food material-container combination which allows the food material to be easily cooked without a pot etc., and which, therefore, greatly reduces the work of clearing up after cooking.

Another object of this invention is to provide a food material-container combination which is particulary adapted for cooking of the food material by a microwave oven and allows the cooking to be carried out in a short time.

These and other objects of this invention will be clear from the following description.

In accordance with the present invention, there is provided a food material-container combination comprising a self-standing container which is made of water resisting material and has a sealable opening at the top; and a food material which solidifies after cooking.

BRIEF DESCRIPTION OF THE DRAWINGS

FIG. 4(I)–4(IV) is a view showing the steps by which a food material containing a coagulant is cooked and coagulated using a self-standing container of the present invention.

DESCRIPTION OF THE PREFERRED EMBODIMENTS

Figure 1:
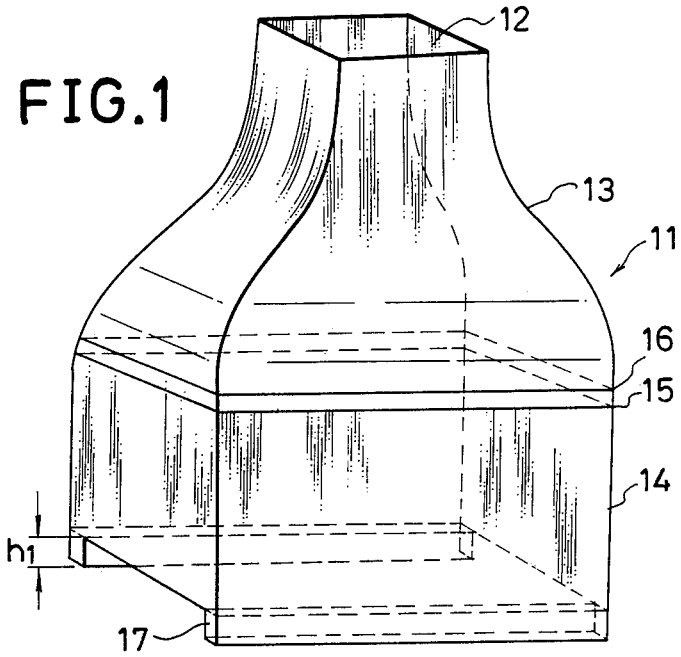
FIGS. 1 and 2 are external views of a self-standing container of the present invention.

It is possible to employ any kind of container as the container of the present invention insofar as it is a self-standing container having a sealable opening at least at the top thereof. The opening is required as a mouth for charging water and food material into the container. A sealable opening is required for preventing the contents from leaking or being spilled out of the container after the contents are charged therein, especially when the contents are mixed by shaking. The structure of the opening may, however, be freely selected from among those capable of attaining the above purpose.

However, as an opening it is preferable to employ a sealable arrangement which can be easily folded by hand because this allows the contents to be easily and reliably sealed and facilitates shaking. In addition, the opening of such constitution has advantages in that the opening maintains its sealed state when the container is heated and when the container is left to stand after heating is stopped, so that the contents can be prevented from boiling over and the contents can also be retained at an appropriate temperature when left to stand. In other words, if the opening should be left without sealing, there would occur disadvantages in that the contents would not fully solidify and would become mud-like when the contents are left to stand after heating. The contents would of course also boil over during heating. Furthermore, a thin film is formed on the surface of tofu when it is allowed to contact the open air, so that the appearance of the tofu becomes bad. However, if the opening of the container maintains its seal, this problem does not occur.

As for the container of the present invention, it is also necessary that the container stand by itself when the contents, e.g. a food material, are charged therein. From this point, there can be used a gusset bag, a one-side gusset bag, a carton-like container, a standing pouch-type container or the like. Among these, it is preferable to use a container whose upper portion is a constituted in a bag-like manner of flexible material and whose bottom portion is constituted in the desired shape of the end product—e.g., a hexahedron or a cube. In this case, the flexible upper portion is easy to seal, and the lower portion gives good stability during free standing.

It is desirable that the container of the present invention be made of a water resisting material which transmits microwaves and is sufficiently heat-resistent to withstand heating by a microwave oven (i.e., is not melted at least up to 100° C.).

Preferable materials are, for example, polyethylene, polypropylene, polycarbonate, polyester, nylon, paper and paper coated with any of these polymers. In this connection, it is also desirable that the part of the container in which the contents are charged (i.e., the part of the container contacting the contents) should be formed of a rigid material or be thickened for the purpose of providing enough stiffness to retain the shape of the end product. It is also necessary that the container should be durable enough not to break when the container is shaken after the contents are charged therein and its opening is sealed. For example, it should be strong enough to withstand a force of no less than 8 newtons applied to the bottom of the bag by shaking.

Beside the above features, the container of the present invention can be provided with a mark for indicating the upper surface of the obtained end product on the inside of the side wall of the container. In this connection, it is preferable that cutting means such as a notch, a cut tape or a zipper be provided near the above position or preferably near the upper portion of the container so as to make it is easy to open the container at such position for taking the end product out after the content has solidified. Furthermore, it is preferable that the region of the container which does not contact with the contents (i.e., the upper portion of the container) should be covered with a microwave shielding layer in order to prevent lathering of the content upon heating by a microwave oven. In this case, all regions except for the portion near the opening are desirably covered with the microwave shielding for inhibiting sparking. The microwave shielding layer is preferably formed of a metallic thin plate which does not transmit microwaves, such as a plate made of aluminum, nickel, chromium, iron, zinc, tin or an alloy made from these metals. In case the container is used in a microwave oven, it is preferable that means for elevating the contents above the microwave oven table be provided on the bottom of the container to increase irradiation of microwaves from the bottom direction and to promote convection heating. It is also preferable that the elevating means should provide a vertical distance between the bottom of the container and the microwave oven table of no less than 2 mm, more preferably 5 to 10 mm.

The present invention can be applied to all types of food materials which solidify after cooking, such as a food material solidified by the action of a coagulant or a food material solidified by protein when heated. Examples of such food materials include a material for tofu, a material for egg tofu, a material for cheese cake and the like. These materials can be in the form of powder, grains, paste etc., which are solidified by mixing with a liquid such as water, milk, sweet sirup etc. For example, the most preferable materials for tofu comprise a main material comprising a powdered or granulated material made by spray-drying soybean milk or a separated soybean protein which is precipitated by adding a precipitating agent such as an acid to soybean milk, vitamins, calcium, a seasoning and the like; and a coagulant such as glucono-delta-lactone.

In the present invention, most preferably only the main food material or both the main food material and a coagulant are charged individually or in combination into the above-mentioned self-standing container, whereby the self-standing container can be used as a packing container as well as a container for cooking and molding. The self-standing container can also be a foldable container packed together with food material.

Figure 4:
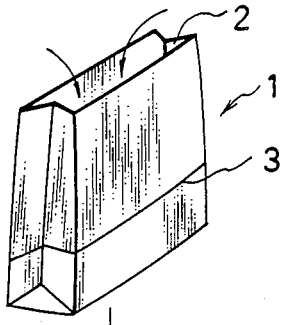
Figure 4:
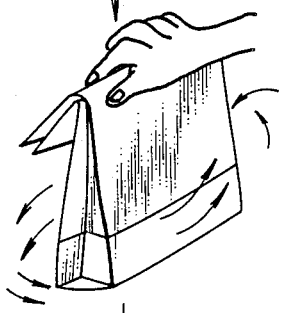
Figure 4:
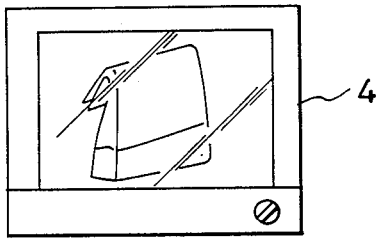
Figure 4:
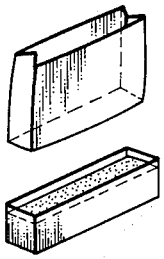

The food material in the food material-container combination of the present invention can easily be cooked and solidified in the manner shown in FIG. 4. Namely, in the first stage a food material and a coagulant are charged in the self-standing container 1 through an opening 2 provided at the top of the container 1. Thereafter an appropriate amount of water is poured therein, as shown in step (I) of FIG. 4. In the next stage, the opening 2 is sealed by folding the upper portion of the container 1 by hand, and the contents are thoroughly mixed by shaking as shown in step (II). In the following step (III), the container is placed in a microwave oven 4 to cook the contents by heating. The container is taken out from the microwave oven after cooking and is left to stand for a fixed time at room temperature to allow the content to solidify and mold. After the content is sufficiently solidified, the bag at the upper portion of the container is cut off (step (IV)), using a means 3 for cutting provided on the container. Thus the end product is obtained. No coagulant is added to the content in the first stage, but one can be added and thoroughly mixed in after cooking in step (III). Furthermore, heating and cooking need not be conducted by a microwave oven, but can instead be conducted by immersing the self-standing container in boiling water.

The basic construction of the present invention has been described, but various modifications thereof are possible within the scope of the claims.

Embodiments of the present invention will now be described hereinunder with reference to the accompanying drawings.

FIG. 1 shows a view of a self-standing container 11 in which food material (not shown in FIG. 1) to be solidified after cooking is charged. The container 11 has an opening 12 at the top portion thereof. The container 11 is constituted of an upper portion 13 and a bottom portion 14. Since the upper portion 13 is formed of a laminated sheet constituted of thin paper/polyethyleneterephthalate/uniaxially oriented polypropylene, the opening 12 can be sealed by folding it by hand. The bottom portion 14 has such volume that the end product solidified and molded is covered with a small air space present over the upper surface of the end product. The bottom portion 14 is formed of a paper laminated with polypropylene which is strong enough to retain the shape of container. A cut tape is also provided upward of the boundary 15 between the upper portion 13 and the bottom portion 14 in order to divide it at that point. On the inner surface the boundary 15, there is provided a mark for indicating the level to which water should be charged. On the bottom of the container, there is provided a means 17 for elevating the container above the microwave oven table ($h_1 = 7$ mm).

Figure 2:
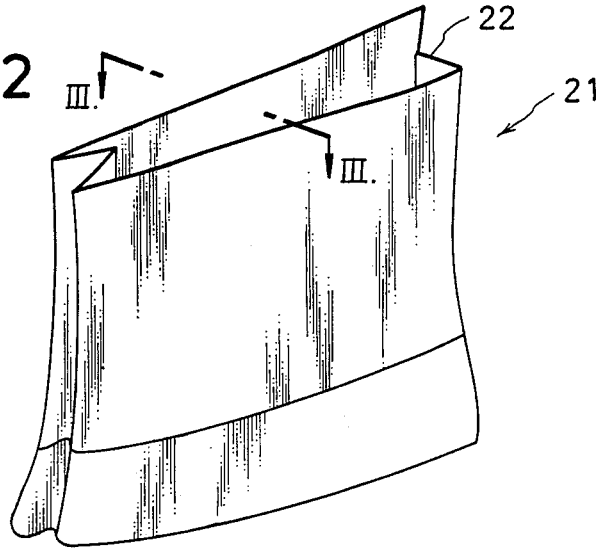
Figure 3:
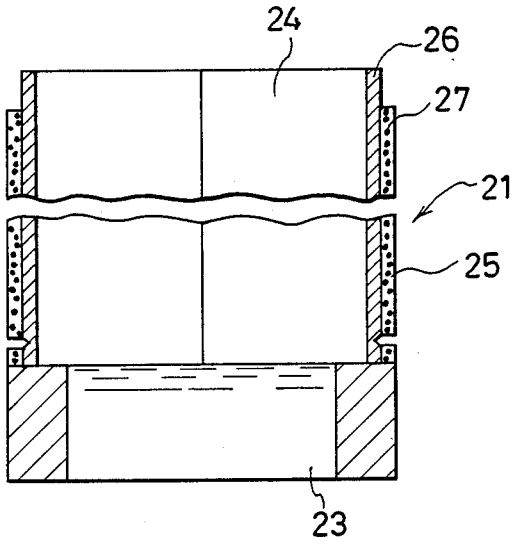
FIG. 3 is an enlarged sectional view taken substantially on line III—III of the self-standing container shown in FIG. 2.

FIG. 2 is a view of another self-standing container 21 of the present invention. The container 21 can be folded at the portion indicated by numeral 22. FIG. 3 is an enlarged sectional view taken substantially along line III—III of FIG. 2. Water and food material 23 containing a coagulant are charged in the container 21. An upper portion 25 having an opening 24 is formed of a laminated film in which a layer 27 of thin paper laminated with polypropylene is further laminated with a microwave shielding layer 26 consisting of aluminum foil.

As is obvious from the above description, according to the present invention, it is not necessary to use a cooking container such as a pot, a container for molding or an egg whisk in order to prepare coagulated foods such as tofu. Food having good apprearance can easily be obtained by the simple procedures of charging a food material containing a coagulant and water into the self-standing container, mixing the food material and the water, and heating and cooking the mixture. Cleaning-up is easily because the self-standing container is disposable. In addition, the time for cooking can be futher shortened by using a microwave oven.

What is claimed is:

1. A food material-container combination for use in a microwave oven, said combination comprising:

(a) a microwave transparent, self-standing container formed of water resisting and heat resisting material, said self-standing container:

(i) comprising a flexible, walled, bag-like upper portion, a rigid bottom portion separably connected to said flexible upper portion, and means for separating said flexible upper portion from said rigid bottom portion after cooking, said rigid bottom portion having side walls and an at least generally planar bottom and said flexible upper portion comprising a microwave shielding layer;

(ii) having an opening in said flexible upper portion, said opening being closable by folding said flexible upper portion along a line above said means for separating said flexible upper portion from said rigid bottom portion after cooking; and (iii) comprising means for vertically elevating said at least generally planar bottom 5–10 mm above a microwave oven table; and (b) a raw food material that solidifies after cooking in said self-standing container disposed in said rigid bottom portion of said self-standing container, (c) said flexible upper portion being dimensioned such that, after said flexible upper portion has been folded closed and before cooking, an unfilled volume remains in said flexible upper portion above the raw food material, whereby:

(d) during cooking, the solidifying food material takes the shape of said rigid bottom portion; and (e) after cooking, said flexible upper portion can be removed from said rigid bottom portion and the solidified food material served in said rigid bottom portion.

2. A food material-container combination as recited in claim 1 wherein said raw food material is a raw material for preparing tofu.

* * * * *